US007190118B2

(12) United States Patent
Vaartjes et al.

(10) Patent No.: US 7,190,118 B2
(45) Date of Patent: Mar. 13, 2007

(54) METAL HALIDE LAMP HAVING IONIZABLE IODIDE SALT

(75) Inventors: Karst Vaartjes, Eindhoven (NL); Marco Haverlag, Eindhoven (NL); Josephus Christiaan Maria Hendricx, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/521,135

(22) PCT Filed: Jun. 17, 2003

(86) PCT No.: PCT/IB03/02744

§ 371 (c)(1),
(2), (4) Date: Jan. 12, 2005

(87) PCT Pub. No.: WO2004/008469

PCT Pub. Date: Jan. 22, 2004

(65) Prior Publication Data

US 2005/0248269 A1 Nov. 10, 2005

(30) Foreign Application Priority Data

Jul. 17, 2002 (EP) ..... 02077896

(51) Int. Cl.
*H01J 17/16* (2006.01)

(52) U.S. Cl. ..... 313/634; 313/637; 313/638; 313/639; 313/642

(58) Field of Classification Search ..... 313/634, 313/637, 638, 639, 640, 641, 642
See application file for complete search history.

(56) References Cited

U.S. PATENT DOCUMENTS 4,422,011 A * 12/1983 Bruninx-Poesen et al.
5,220,244 A * 6/1993 Maseki et al. ..... 313/620
5,363,015 A * 11/1994 Dakin et al. ..... 313/638

FOREIGN PATENT DOCUMENTS

EP 0587238 9/1993
WO WO0067294 11/2000

* cited by examiner

*Primary Examiner*—Joseph Williams
*Assistant Examiner*—Hana A. Sanei

(57) ABSTRACT

A metal halide lamp comprising a substantially cylindrical discharge vessel having an internal diameter Di<2.0 mm and filled with an ionizable filling, wherein two electrodes are present at a mutual distance EA for maintaining a discharge in the discharge vessel, wherein the filling comprises an inert gas, such as Xe, having a pressure at room temperature between 5 and 25 bar, and an ionizable salt, characterized in that said ionizable salt is selected from the group comprising PrI3, NdI3 and LuI3.

34 Claims, 1 Drawing Sheet

METAL HALIDE LAMP HAVING IONIZABLE IODIDE SALT

Figure 1:
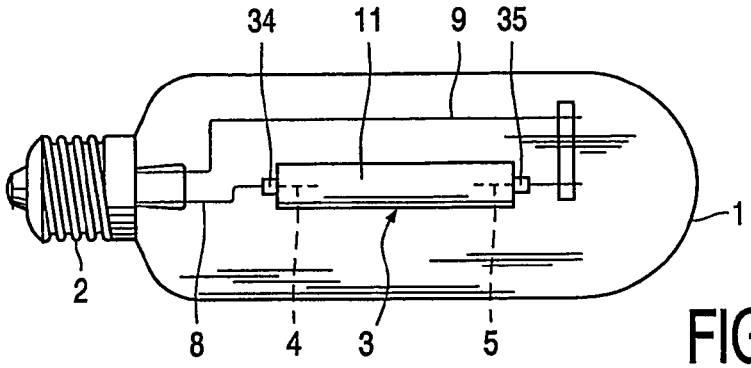

The invention relates to an automotive metal halide lamp comprising a substantially cylindrical discharge vessel having an internal diameter Di<2.0 mm, and filled with an ionizable filling, wherein two electrodes are present at a mutual distance EA, wherein preferably 3 mm<EA<7 mm, for maintaining a discharge in the discharge vessel, and wherein the filling comprises an inert gas such as Xe having a pressure at room temperature between 5 and 25 bar, and an ionizable salt.

Such a lamp is described in the international patent application WO 00/67294. Many modern automotive metal halide lamps have a very small, very high pressure discharge vessel surrounded by a gas-filled outer bulb, and have a lamp power between 20 W and 40 W. The filling of the lamp can contain Hg, or alternatively can be mercury-free and contain Zn or $ZnI_2$. Such lamps require highly efficient ionizable salts, and it is known to use a salt mixture of NaI and $CeI_3$. Such a lamp is based on the recognition that a high efficacy and a sufficiently high color rendering is possible when sodium halide is used as a filling ingredient of a lamp and a strong widening and inversion of the Na emission in the Na-D lines takes place during lamp operation. This requires a high coldest-spot temperature in the discharge vessel, which excludes under practical conditions the use of quartz or quartz glass for the discharge vessel wall and renders the use of a ceramic material for the discharge vessel wall preferable. The term "ceramic wall" in the present description and claims is understood to cover a wall of metal oxide such as, for example, sapphire or densely sintered polycrystalline $Al_2O_3$, as well as metal nitride, for example AlN. The known lamp combines a good color rendering with a comparatively wide range of the color temperature.

The lamp has the advantage that the discharge vessel has very compact dimensions which render the lamp highly suitable for use in a headlamp for a motor vehicle. Owing to the small internal diameter in comparison with the electrode spacing, and thus the discharge arc length, the discharge arc is hemmed in by the discharge vessel wall, so that the discharge arc has a sufficiently straight shape for it to be suitable for use as a light source for a motor vehicle headlamp. A small internal diameter Di is found to be of essential importance for realizing a sharp beam delineation necessary for use in motor vehicles in combination with a small spot of high brightness immediately adjacent this delineation. Such very small internal diameter renders the lamp particularly suitable for use as a light source in a complex-shape headlamp. An advantage of such a headlamp is that no separate passing-beam cap is required in the formation of the light beam to be generated in order to realize a sufficiently sharp beam delineation.

The drawbacks of the known lamp are however a relatively low correlated color temperature (CCT) (between 3000 and 3500 K), a relatively unstable luminous flux, a relatively unstable wall temperature, a relatively large initial color point spread and a relatively large color point shift during life time, mainly due to chemical transport and segregation of the NaI/$CeI_3$ salt mix.

The object of the invention is an automotive metal halide lamp wherein one or more of the above-mentioned drawbacks are alleviated. In order to achieve that goal, said ionizable salt is selected from the group comprising $PrI_3$, $NdI_3$ and $LuI_3$. Preferably said ionizable salt further comprises NaI, wherein the molar ratio NaI/($PrI_3$+$NdI_3$+$LuI_3$) lies between 1.0 and 10.3. Although usually one of the above-mentioned rare earth iodides will be used, it is possible to use a mixture as well. It was found that in a lamp of the above-mentioned properties these salts are only slightly sensitive to big variations in lamp power and thus in coldest spot temperature, while showing a color spot close to the BBL ("black body line"), and that these salts are relatively insensitive to color shifts due to segregation, i.e. changes in the salt mix ratio at the coldest spot position of the lamp due to for instance corrosion or transport of the liquid salt. In particular the use of $PrI_3$ results in an excellent color temperature for automotive purposes, close to the preferred CCT of 4200 K, while if $LuI_3$ is used for instance the color temperature can be enhanced by adding small amounts of $TbI_3$ and/or $GdI_3$.

In a first preferred embodiment the molar ratio NaI/$PrI_3$ lies between 2.3 and 10.3, preferably between 3.0 and 5.7, and more preferably is approximately 3.5. Preferably the amount of $PrI_3$ in the discharge vessel is between 10 and 335 μmol/$cm^3$, more preferably between 25 and 160 μmol/$cm^3$, still more preferably approximately 50 μmol/$cm^3$. In a discharge vessel of 1.6 mm×8 mm (Di×EA) this results in a CCT of approximately 4200 K. In a discharge vessel of 1.2 mm×6 mm the preferred concentration is 1.8 times higher in order to have the same CCT.

In a second preferred embodiment the molar ratio NaI/$NdI_3$ lies between 3 and 6.7, preferably between 3.6 and 4.8, and more preferably is approximately 4.2. Preferably the amount of $NdI_3$ in the discharge vessel is between 8 and 301 μmol/$cm^3$, more preferably between 30 and 167 μmol/$cm^3$, still more preferably approximately 45 μmol/$cm^3$. In a discharge vessel of 1.6 mm×8 mm (Di×EA) this results in a CCT of approximately 4200 K. In a discharge vessel of 1.2 mm×6 mm the preferred concentration is 1.8 times higher in order to have the same CCT.

In a third preferred embodiment the molar ratio NaI/$LuI_3$ lies between 1.0 and 3.2, preferably between 1.2 and 1.8, and more preferably is approximately 1.4. Preferably the amount of $LuI_3$ in the discharge vessel is between 15 and 414 μmol/$cm^3$, more preferably between 27 and 230 μmol/$cm^3$, still more preferably approximately 69 μmol/$cm^3$. In a discharge vessel of 1.6 mm×8 mm (Di×EA) this results in a CCT of approximately 4200 K. In a discharge vessel of 1.2 mm×6 mm the preferred concentration is 1.8 times higher in order to have the same CCT.

These and other aspects of the lamp according to the invention will be explained in more detail with reference to the drawings (not to scale), wherein:

FIG. 1 diagrammatically shows a lamp according to the invention; and

Figure 2:
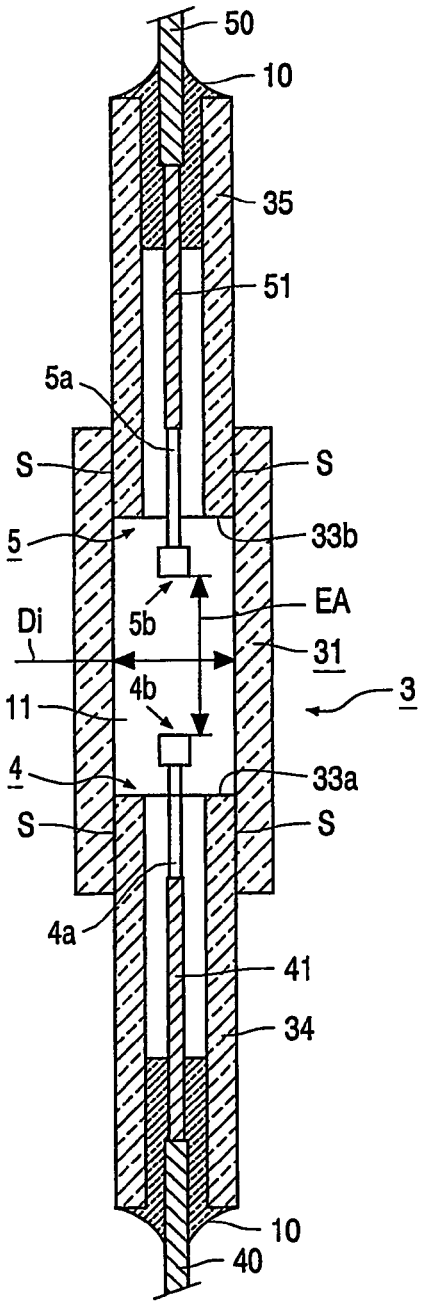

FIG. 2 shows the discharge vessel of the lamp of FIG. 1 in detail.

FIG. 1 shows a metal halide lamp provided with a discharge vessel 3 having a ceramic wall which encloses a discharge space 11 containing an ionizable filling. Two tungsten electrodes 4, 5 whose tips 4*b*, 5*b* are at a mutual distance EA are arranged in the discharge space, and the discharge vessel has an internal diameter Di at least over the distance EA. The discharge vessel is closed at one side by means of a ceramic projecting plug 34, 35 which encloses a current lead-through conductor (FIG. 2: 40, 41, 50, 51) to an electrode 4, 5 positioned in the discharge vessel with a narrow intervening space and is connected to this conductor in a gastight manner by means of a melting-ceramic joint (FIG. 2: 10) at an end remote from the discharge space. The discharge vessel is surrounded by an outer bulb 1 which is provided with a lamp cap 2 at one end. A discharge will extend between the electrodes 4, 5 when the lamp is operating. The electrode 4 is connected to a first electrical contact forming part of the lamp cap 2 via a current conductor 8. The electrode 5 is connected to a second electrical contact forming part of the lamp cap 2 via a current conductor 9. The discharge vessel, shown in more detail in FIG. 2 (not to scale), has a ceramic wall and is formed from a cylindrical part with an internal diameter Di which is bounded at either end by a respective ceramic projecting plug 34, 35 which is fastened in a gastight manner in the cylindrical part by means of a sintered joint S. The ceramic projecting plugs 34, 35 each narrowly enclose a current lead-through conductor 40, 41, 50, 51 of a relevant electrode 4, 5 having a tip 4*b*, 5*b*. The current lead-through conductor is connected to the ceramic projecting plug 34, 35 in a gastight manner by means of a melting-ceramic joint 10 at the side remote from the discharge space. The electrode tips 4*b*, 5*b* are arranged at a mutual distance EA. The current lead-through conductors each comprise a halide-resistant portion 41, 51, for example in the form of a Mo—$Al_2O_3$ cermet and a portion 40, 50 which is fastened to a respective end plug 34, 35 in a gas tight manner by means of the melting-ceramic joint 10. The melting-ceramic joint extends over some distance, for example approximately 1 mm, over the Mo cermet 40, 41. It is possible for the parts 41, 51 to be formed in an alternative manner instead of from a Mo—$Al^2O^3$ cermet. Other possible constructions are known, for example, from EP 0 587 238. A particularly suitable construction was found to be a halide-resistant coil applied around a pin of the same material. Mo is very suitable for use as a highly halide-resistant material. The parts 40, 50 are made from a metal whose coefficient of expansion corresponds very well to that of the end plugs. Nb, for example, is a highly suitable material for this purpose. The parts 40, 50 are connected to the current conductors 8, 9 in a manner not shown in any detail. The lead-through construction described renders it possible to operate the lamp in any desired burning position. Each of the electrodes 4, 5 comprises an electrode rod 4*a*, 5*a* which is provided with a tip 4*b*, 5*b*.

In a practical embodiment of the lamp as represented in the drawing, a number of lamps were manufactured with a rated power of 26 W each. The lamps are suitable for use as headlamps for a motor vehicle. The ionizable filling of the discharge vessel 3 of each individual lamp comprises 30 mg/cm$^3$ Hg and 25 mg/cm$^3$ iodide, comprising NaI and a rare earth iodide chosen from the group consisting of $PrI_3$, $NdI_3$ and $LuI_3$. In a mercury-free embodiment Hg may be replaced by Zn or $ZnI_2$. The filling further comprises Xe with a filling pressure at room temperature of 8 bar. The distance between the electrode tips 4*a*, 5*a* EA is 5 mm, the internal diameter Di is 1.4 mm, so that the ratio EA/Di=3.6. The wall thickness of the discharge vessel 3 is 0.3 mm.

In a first embodiment the rare earth iodide is $PrI_3$ at approximately 50 μmol/cm$^3$, and the molar ratio NaI/$PrI_3$ is approximately 3.5.

In a second embodiment the rare earth iodide is $NdI_3$ at 45 μmol/cm$^3$, and the molar ratio NaI/$NdI_3$ is approximately 4.2.

In a third embodiment the rare earth iodide is $LuI_3$ at 69 μmol/cm$^3$, and the molar ratio NaI/$LuI_3$ is approximately 1.4. In order to improve the color temperature of this lamp, small amounts of $TbI_3$ or $GdI_3$ were added.

The lamps described showed excellent color temperature and color stability properties compared to NaI/$CeI_3$ fillings, while the efficacy is only slightly lower.

The invention claimed is:

1. A metal halide lamp comprising a substantially cylindrical discharge vessel (3) having an internal diameter Di<2.0 mm and filled with an ionizable filling, wherein two electrodes are present at a mutual distance EA for maintaining a discharge in the discharge vessel, wherein the filling comprises an inert gas having a pressure at room temperature between 5 and 25 bar, and an ionizable salt, characterized in that said ionizable salt is selected from the group comprising $PrI_3$, $NdI_3$ and $LuI_3$.

2. A lamp according to claim 1, wherein said ionizable salt further comprises NaI, and wherein the molar ratio NaI/($PrI_3$+$NdI_3$+$LuI_3$) lies between 1.0 and 10.3.

3. A lamp according to claim 2, wherein the molar ratio NaI/$PrI_3$ lies between 2.3 and 10.3.

4. A lamp according to claim 3, wherein the molar ratio NaI/$PrI_3$ lies between, preferably between 3.0 and 5.7.

5. A lamp according to claim 4, wherein the molar ratio NaI/$PrI_3$ is approximately 3.5.

6. A lamp according to claim 2, wherein the molar ratio NaI/$NdI_3$ lies between 3.0 and 67.

7. A lamp according to claim 6, wherein the molar ratio NaI/$NdI_3$ lies between 3.6 and 4.8.

8. A lamp according to claim 7, wherein the molar ratio NaI/$NdI_3$ is approximately 4.2.

9. A lamp according to claim 2, wherein the molar ratio NaI/$LuI_3$ lies between 1.0 and 3.2.

10. A lamp according to claim 9, wherein the molar ratio NaI/$LuI_3$ lies between 1.2 and 1.8.

11. A lamp according to claim 10, wherein the molar ratio NaI/$LuI_3$ is approximately 1.4.

12. A lamp according to claim 1, wherein the amount of $PrI_3$ in the discharge vessel is between 10 and 335 μmol/cm$^3$.

13. A lamp according to claim 12, wherein the amount of $PrI_3$ in the discharge vessel is between 25 and 160 μmol/cm$^3$.

14. A lamp according to claim 13, wherein the amount of $PrI_3$ in the discharge vessel is approximately 50 μmol/cm$^3$.

15. A lamp according to claim 1, wherein the amount of $NdI_3$ in the discharge vessel is between 8 and 301 μmol/cm$^3$.

16. A lamp according to claim 15, wherein the amount of $NdI_3$ in the discharge vessel is between 30 and 167 μmol/cm$^3$.

17. A lamp according to claim 16, wherein the amount of $NdI_3$ in the discharge vessel is approximately 45 μmol/cm$^3$.

18. A lamp according to claim 1, wherein the amount of $LuI_3$ in the discharge vessel is between 15 and 414 μmol/cm$^3$.

19. A lamp according to claim 18, wherein the amount of $LuI_3$ in the discharge vessel is between 27 and 230 μmol/cm$^3$.

20. A lamp according to claim 19, wherein the amount of $LuI_3$ in the discharge vessel is approximately 69 μmol/cm$^3$.

21. A lamp according to claim 1, wherein Di<1.5 mm.

22. A lamp according to claim 1, wherein EA lies between 3 mm and 7 mm.

23. A lamp according to claim 1, wherein the discharge vessel has a ceramic wall.

24. A lamp according to claim 1, wherein the discharge vessel is surrounded by a gas-filled outer bulb.

25. A lamp according to claim 1, wherein the lamp power lies between 20 W and 40 W.

26. A metal halide lamp comprising a substantially cylindrical discharge vessel (3) having an internal diameter Di<2.0 mm and filled with an ionizable filling, wherein two electrodes are present at a mutual distance EA for maintaining a discharge in the discharge vessel, wherein the filling comprises an inert gas having a pressure at room temperature between 5 and 25 bar, and an ionizable salt selected from the group comprising $PrI_3$, $NdI_3$ and $LuI_3$, wherein the amount of $NdI_3$ in the discharge vessel is between 8 and 301 μmol/cm$^3$.

27. A lamp according to claim 26, wherein the amount of $NdI_3$ in the discharge vessel is between 30 and 167 μmol/cm$^3$.

28. A lamp according to claim 27, wherein the amount of $NdI_3$ in the discharge vessel is approximately 45 μmol/cm$^3$.

29. A metal halide lamp comprising a substantially cylindrical discharge vessel (3) having an internal diameter Di<2.0 mm and filled with an ionizable filling, wherein two electrodes are present at a mutual distance LA for maintaining a discharge in the discharge vessel, wherein the filling comprises an inert gas having a pressure at room temperature between 5 and 25 bar, and an ionizable salt selected from the group comprising $PrI_3$, $NdI_3$ and $LuI_3$, wherein said ionizable salt further comprises NaI, and wherein the molar ratio $NaI/(PrI_3+NdI_3+LuI_3)$ lies between 1.0 and 3.2.

30. A lamp according to claim 29, wherein the molar ratio $NaI/(PrI_3+NdI_3+LuI_3)$ lies between 1.2 and 1.8.

31. A lamp according to claim 30, wherein the molar ratio $NaI/(PrI_3+NdI_3+LuI_3)$ is approximately 1.4.

32. A metal halide lamp comprising a substantially cylindrical discharge vessel (3) having an internal diameter Di<2.0 mm and filled with an ionizable filling, wherein two electrodes are present at a mutual distance EA for maintaining a discharge in the discharge vessel, wherein the filling comprises an inert gas having a pressure at room temperature between 5 and 25 bar, and an ionizable salt selected from the group comprising $PrI_3$, $NdI_3$ and $LuI_3$, wherein the amount of $LuI_3$ in the discharge vessel is between 15 and 414 μmol/cm$^3$.

33. A lamp according to claim 32, wherein the amount of $LuI_3$ in the discharge vessel is between 27 and 230 μmol/cm$^3$.

34. A lamp according to claim 33, wherein the amount of $LuI_3$in the discharge vessel is approximately 69 μmol/cm$^3$.

* * * * *